US005614693A

United States Patent [19]

Welch

[11] Patent Number: 5,614,693

[45] Date of Patent: Mar. 25, 1997

[54] ACCESSORY CHARGES FOR BOOSTER EXPLOSIVE DEVICES

[75] Inventor: Brendan M. Welch, Farmington, Conn.

[73] Assignee: The Ensign-Bickford Company, Simsbury, Conn.

[21] Appl. No.: 548,812

[22] Filed: Jan. 11, 1996

[51] Int. Cl.[6] ..... F42B 3/00; C06C 5/04

[52] U.S. Cl. ..... 102/318; 102/331; 102/275.4; 102/275.5

[58] Field of Search ..... 102/318, 331, 102/275.4, 275.5, 275.6

[56] References Cited

U.S. PATENT DOCUMENTS

| | | | |
|---|---|---|---|
| Re. 30,621 | 5/1981 | Calder, Jr. et al. | 102/313 |
| Re. 31,953 | 7/1985 | Calder, Jr. et al. | 86/20 C |
| 905,336 | 12/1908 | Lheure | 102/313 |
| 954,595 | 4/1910 | Spery | 102/318 |
| 3,048,103 | 8/1962 | Blair, Jr. et al. | 102/22 |
| 3,357,355 | 12/1967 | Roush | 102/24 |
| 3,431,849 | 3/1969 | Kern et al. | 102/24 |
| 3,491,687 | 1/1970 | Cholet | 102/24 |
| 3,709,149 | 1/1973 | Driscoll | 102/22 |
| 3,747,527 | 7/1973 | Griffith | 102/24 R |
| 3,793,954 | 2/1974 | Johnston | 102/28 R |
| 3,942,444 | 3/1976 | Greene | 102/70 R |
| 4,060,033 | 11/1977 | Postupack et al. | 102/24 R |
| 4,060,034 | 11/1977 | Bowman et al. | 102/24 R |
| 4,165,691 | 8/1979 | Bowman et al. | 102/24 R |
| 4,178,852 | 12/1979 | Smith et al. | 102/24 R |
| 4,290,486 | 9/1981 | Regalbuto | 166/297 |
| 4,295,424 | 10/1981 | Smith et al. | 102/322 |
| 4,335,652 | 6/1982 | Bryan | 102/202.1 |
| 4,354,433 | 10/1982 | Owen | 102/307 |
| 4,383,484 | 5/1983 | Morrey | 102/275.3 |
| 4,425,849 | 1/1984 | Jorgenson | 102/275.12 |
| 4,425,850 | 1/1984 | Grossler | 102/307 |
| 4,426,933 | 1/1984 | Yunan | 102/275.3 |
| 4,481,884 | 11/1984 | Yunan | 102/313 |
| 4,485,741 | 12/1984 | Moore et al. | 102/331 |
| 4,527,482 | 7/1985 | Hynes | 102/331 |
| 4,637,312 | 1/1987 | Adams et al. | 102/275.12 |
| 4,653,400 | 3/1987 | Crawford | 102/202 |
| 4,718,345 | 1/1988 | Yunan | 102/275.3 |
| 4,745,862 | 5/1988 | Arnell et al. | 102/424 |
| 4,765,246 | 8/1988 | Carlsson et al. | 102/318 |
| 4,776,276 | 10/1988 | Yunan | 102/275.5 |
| 4,796,533 | 1/1989 | Yunan | 102/322 |
| 4,799,428 | 1/1989 | Yunan | 102/322 |
| 4,815,382 | 3/1989 | Yunan | 102/275.7 |
| 4,879,952 | 11/1989 | Dowing et al. | 102/331 |
| 4,938,143 | 7/1990 | Thomas et al. | 102/318 |
| 5,377,592 | 1/1995 | Rode et al. | 102/210 |
| 5,435,248 | 7/1995 | Rode et al. | 102/210 |
| 5,492,366 | 2/1996 | Osborne et al. | 280/741 |

FOREIGN PATENT DOCUMENTS 934224 9/1973 Canada .

*Primary Examiner*—Peter A. Nelson

*Attorney, Agent, or Firm*—Victor E. Libert; Frederick A. Spaeth

[57] ABSTRACT

An accessory charge (20) for mounting on a booster explosive device (10) is preferably of toroidal configuration including a hub opening (29) dimensioned and configured to engage the accessory charge (20) with the booster device (10). The booster device (10) may have exterior threads (32) which are engaged by the interior threads (34) of the accessory charge (20). The outer peripheral surface (26) of the accessory charge (20) may be concave in cross section so that the accessory charge (20) comprises a shaped charge facing radially outwardly thereof. The accessory charge (20) may be combined with the booster device (10) to provide a charge assembly (30).

19 Claims, 6 Drawing Sheets

ACCESSORY CHARGES FOR BOOSTER EXPLOSIVE DEVICES

BACKGROUND OF THE INVENTION

Field Of The Invention

The present invention relates to explosive charges, more particularly to accessory charges for use in conjunction with explosives generally referred to as booster or primer explosives and to combinations of such accessory charges with such booster charges. Such combinations are intended primarily for use within boreholes and the like to initiate detonation of a larger mass of relatively insensitive explosive.

Related Art

U.S. Pat. No. 4,938,143 issued Jul. 3, 1990 to R. D. Thomas et al and entitled "Booster Shaped For High-Efficiency Detonating", discloses a booster explosive having an "interface" surface at one end which is configured to contact a column of a relatively insensitive explosive while being directed towards the majority of the insensitive explosives content of the column. The body portion of the booster has sides which taper to an opposite, second end thereof which second end has a cross-sectional area which is smaller than the interface end. While Thomas et al discloses a wide variety of such tapered shapes and illustrates many in the drawings, the preferred embodiment is shown in FIG. 5 of Thomas et al wherein the booster explosive has generally the configuration of a frustrum of a right angle cone. The Thomas et al booster is disposed at or near the bottom of a borehole filled with a mass of insensitive explosive, typically a blasting agent, with the base facing upwardly towards the major portion of explosive within the borehole. Commercially available embodiments of the Thomas et al invention are known in which a booster explosive shaped generally similar to that illustrated in FIG. 5 of Thomas et al is encased within a molded synthetic polymeric (plastic) container. As illustrated in FIG. 5 of Thomas et al, the frustoconical shaped booster contains three bores formed therein, one of which comprises a dead-end passageway (152) within which a blasting cap (154) is inserted, another of which passageway (148) extends through the booster explosive for passage therethrough of its signal transmitting cord (156) to the surface. A third passageway (146) extends along the longitudinal center axis of the booster explosive and is stated to permit threading therethrough of the signal transmission cord of another detonator positioned in the borehole below the illustrated booster.

SUMMARY OF THE INVENTION

In accordance with the present invention there is provided an explosive accessory charge for mounting on a booster explosive device having a longitudinal axis and a housing having a housing exterior, and within which housing an explosive primer charge is enclosed. The accessory charge is dimensioned and configured to be mounted on the booster device radially outwardly thereof.

The following features, alone or in combination, comprise additional aspects of the invention: the accessory charge may comprise accessory mounting means dimensioned and configured to engage the accessory charge with the booster device; the accessory charge may be dimensioned and configured to circumscribe such booster device; and the accessory charge may have a toroidal configuration including a hub opening dimensioned and configured to enclose such booster device therein.

In another aspect of the invention such booster device has device mounting means on the exterior thereof, and the accessory charge has thereon accessory mounting means, which may be located on the hub opening, the device mounting means and the accessory mounting means being dimensioned and configured to engage each other to mount the accessory charge on such booster device.

Another aspect of the invention provides for the hub opening to be defined by a hub wall and the accessory mounting means to comprise accessory screw threads formed on the hub wall.

Yet another aspect of the invention provides for a combination of the accessory charge with such booster device. In a related aspect concerning the combination of the booster device and the accessory charge, the device mounting means may comprise device threads formed on the exterior of the housing of the booster device, which device threads are complementary to the aforesaid accessory screw threads.

The combination of the present invention also provides for the booster device to have an active end and an opposite coupling end, and for the device and accessory mounting means to be dimensioned and configured to locate the accessory charge between the active end and the coupling end.

An aspect in accordance with the combination of the present invention provides for the booster device to contain a primary charge comprised of a main body disposed adjacent the active end of the device and a stem portion disposed adjacent the coupling end of the device, and the device and accessory mounting means are each dimensioned and configured to position the accessory charge radially outwardly of the main body when the accessory charge is coupled to the booster device.

Another aspect of the combination of the invention provides for the accessory charge to be of toroidal configuration and to circumscribe the entire periphery of the explosive device when the accessory charge is connected thereto.

Still another aspect of the present invention provides for the accessory charge to have an outer peripheral surface which is concave in cross section, whereby the accessory charge comprises a shaped charge facing radially outwardly thereof. In a related aspect, the concave surface is symmetrical about a plane passed perpendicularly to the longitudinal axis of the accessory charge.

Other aspects of the invention will be apparent from the following description and the appended drawings.

DETAILED DESCRIPTION OF THE INVENTION AND SPECIFIC EMBODIMENTS THEREOF

Figure 1:
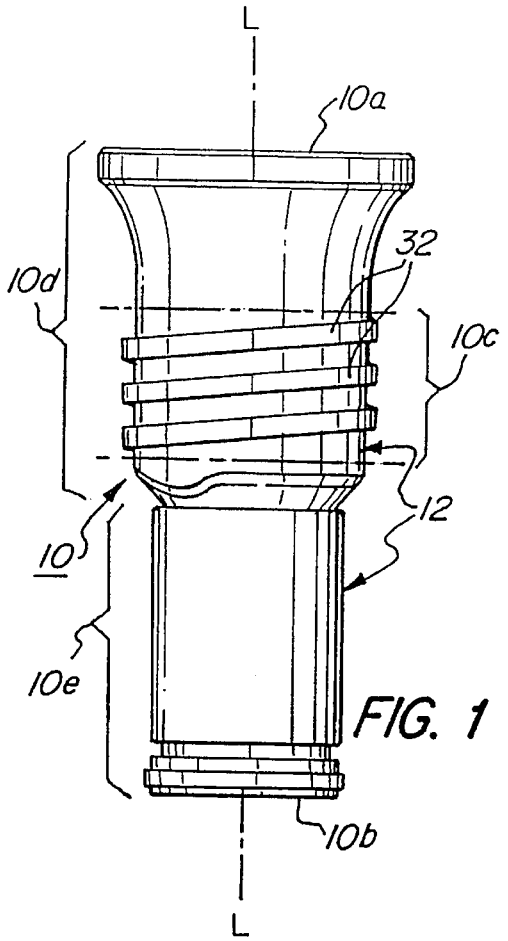
FIG. 1 is an elevation view of a booster explosive device in accordance with one embodiment of the present invention.

FIG. 1 shows a booster explosive device 10 having a longitudinal axis L—L and comprising a hollow housing 12 defining an enclosure within which is contained an explosive primer charge 14 (FIGS. 2, 7 and 8). primer charge 14 may comprise any suitable explosive, e.g., a mixture of pentaerythritol tetranitrate ("PETN") and trinitrotoluene ("TNT") and is normally cast within housing 12. Consequently, housing 12 defines the shape of both the exterior of device 10 and of primer charge 14 contained therewithin, the latter comprising a stem portion 14*b* (FIGS. 2, 7 and 8) which, in the illustrated embodiment, is of generally U-shape in cross section (as will be appreciated from FIG. 5), and a main portion 14*a* which is of larger diameter than stem portion 14*b* and terminates in the outwardly flared active end 10*a* of device 10. Obviously, any other suitable shape of primer charge 14 may be utilized, including one in which the stem portion 14*b* is of circular cross section instead of the illustrated U-shaped cross section, one in which main portion 14*a* has a non-flared configuration, one in which main portion 14*a* and stem portion 14*b* have a constant circular or other cross section, etc. Similarly, the outwardly flared active end 10*a* of device 10 could be formed in a stepped instead of the smoothly flared configuration shown.

In the illustrated embodiment, booster explosive device 10 (FIG. 1) thus has an active end 10*a* thereof which terminates in an active surface 11 (FIGS. 4, 5, 7 and 8) and is of larger diameter than an opposite, coupling end 10*b* thereof. Booster device 10 comprises a main section 10*d* corresponding to and comprised of main portion 14*a* of primer charge 14 and a stem section 10*e* corresponding to and comprised of stem portion 14*b* of primer charge 14. Active surface 11 of device 10 extends transversely of the longitudinal axis L—L thereof and, in the illustrated embodiment, is substantially flat.

Figure 2:
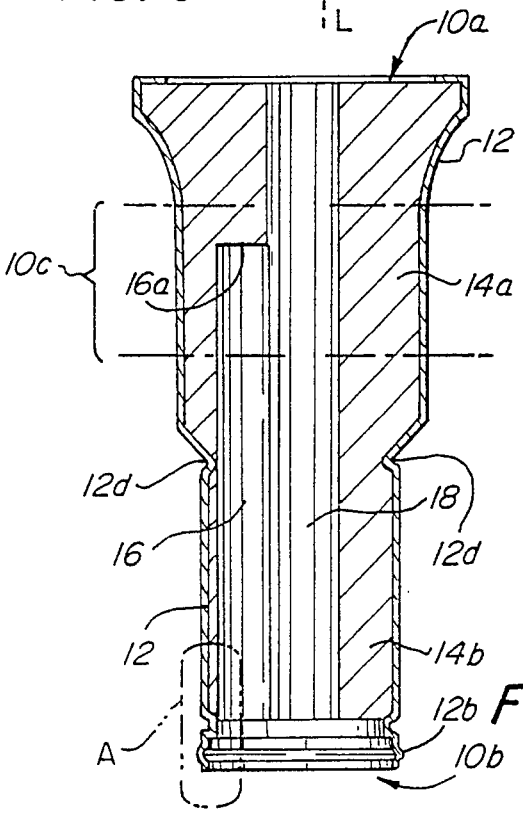
FIG. 2 is a longitudinal cross-sectional view of the device of FIG. 1.

As best seen in FIG. 2, a detonator well 16 and a line well 18 are formed in primer charge 14, usually by emplacing removable casting fixtures within housing 12 and pouring molten explosive material into housing 12 around the removable casting fixtures. For this purpose the larger diameter end 12*a* of housing 12 is temporarily closed by another fixture during the casting process, after which the explosive material hardens within housing 12 to provide primer charge 14. Detonator well 16 terminates in an end wall 16*a* (FIG. 2) whereas line well 18 extends entirely through primer charge 14.

Generally, device 10 (FIG. 1) is configured to have a stem section 10*e* which, in the illustrated embodiment, is of smaller diameter than main section 10*d* and correspondingly provides primer charge 14 thereof with a stem portion 14*b* (FIG. 2) which is of smaller diameter than a main portion 14*a* thereof. Main section 10*d* of device 10 includes an accessory section 10*c* which, in the illustrated embodiment, is of generally constant cross section. Accessory section 10*c* is the section of device 10 which, in certain embodiments of the invention, is enclosed by an explosive accessory charge 20. Detonator well 16 is dimensioned and configured to extend to within the accessory section 10*c* of the device 10 and the line well 18 is dimensioned and configured to receive therein a downline comprising a detonating cord, preferably, to also receive therein a shielding tube for the detonating cord. The device 10 is apertured to admit passage of such detonating cord therethrough. The line well 18 preferably extends along the longitudinal axis L—L of the device 10.

Figure 3:
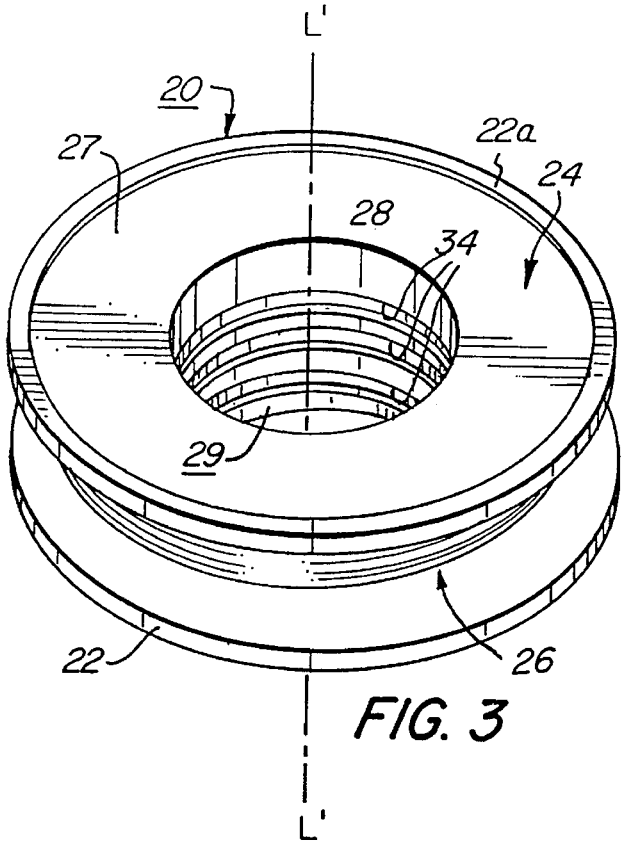
FIG. 3 is a perspective view of a generally disc-shaped explosive accessory charge adapted to be affixed as an accessory charge to the exterior of the device of FIG. 1.
Figure 4:
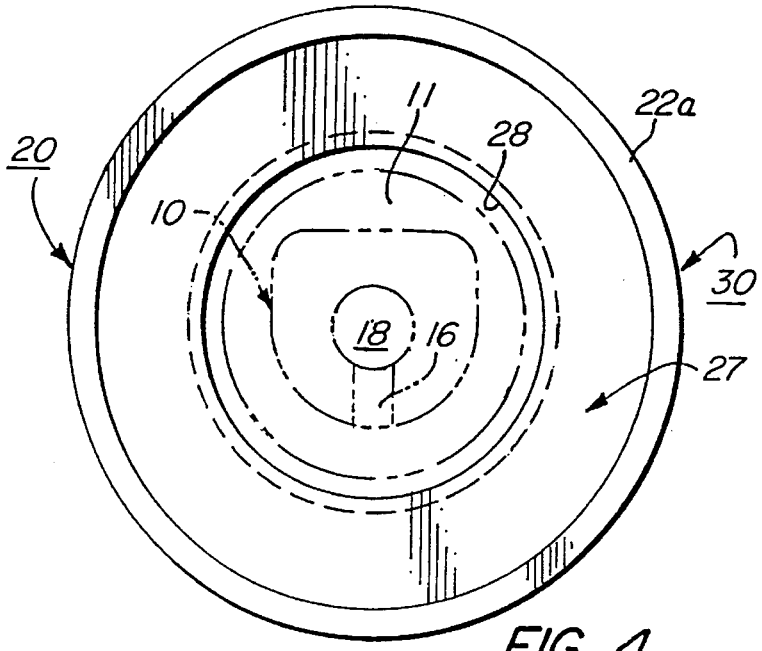
FIG. 4 is a plan view of the device of FIG. 1 with the accessory charge of FIG. 3 mounted thereon.
Figure 8:
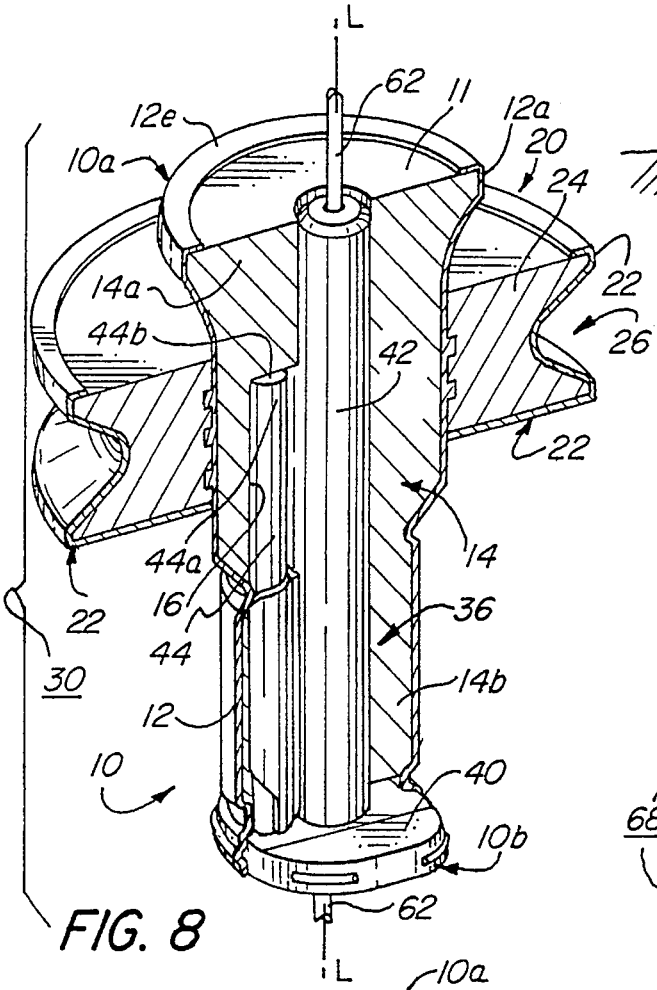
FIG. 8 is a perspective view of a longitudinal cross section of the device of FIG. 5 with the slider unit of FIG. 6 and a detonator mounted therein, and a downline extending therethrough.

The illustrated embodiment of accessory charge 20 (best seen in FIGS. 3, 5 and 8) is generally of toroidal shape and comprises an accessory housing 22 which provides a receptacle, shaped somewhat like a Bundt cake pan, into which molten explosive is poured and hardens to provide therein an accessory explosive 24. As best seen in FIGS. 3, 4 and 8, accessory housing 22 terminates in a retainer rim 22*a* which serves to secure the hardened accessory explosive 24 in place within the accessory housing 22 of accessory charge 20.

Referring now to FIG. 3, accessory charge 20 is seen to have a longitudinal axis L'—L', is symmetrical thereabout, has an outer peripheral surface 26 which is concave in cross section as best seen in FIG. 8, and an upper surface 27. Accessory charge 20 further has an inner peripheral surface 28 which defines a central hub opening 29. When accessory charge 20 is assembled to device 10 to provide charge assembly 30, upper surface 27 faces in the direction of active end 10*a* of device 10. Upper surface 27 is seen to extend transversely of the longitudinal axis L'—L' of accessory charge 20 and, in the illustrated embodiment, is substantially flat.

Figure 5:
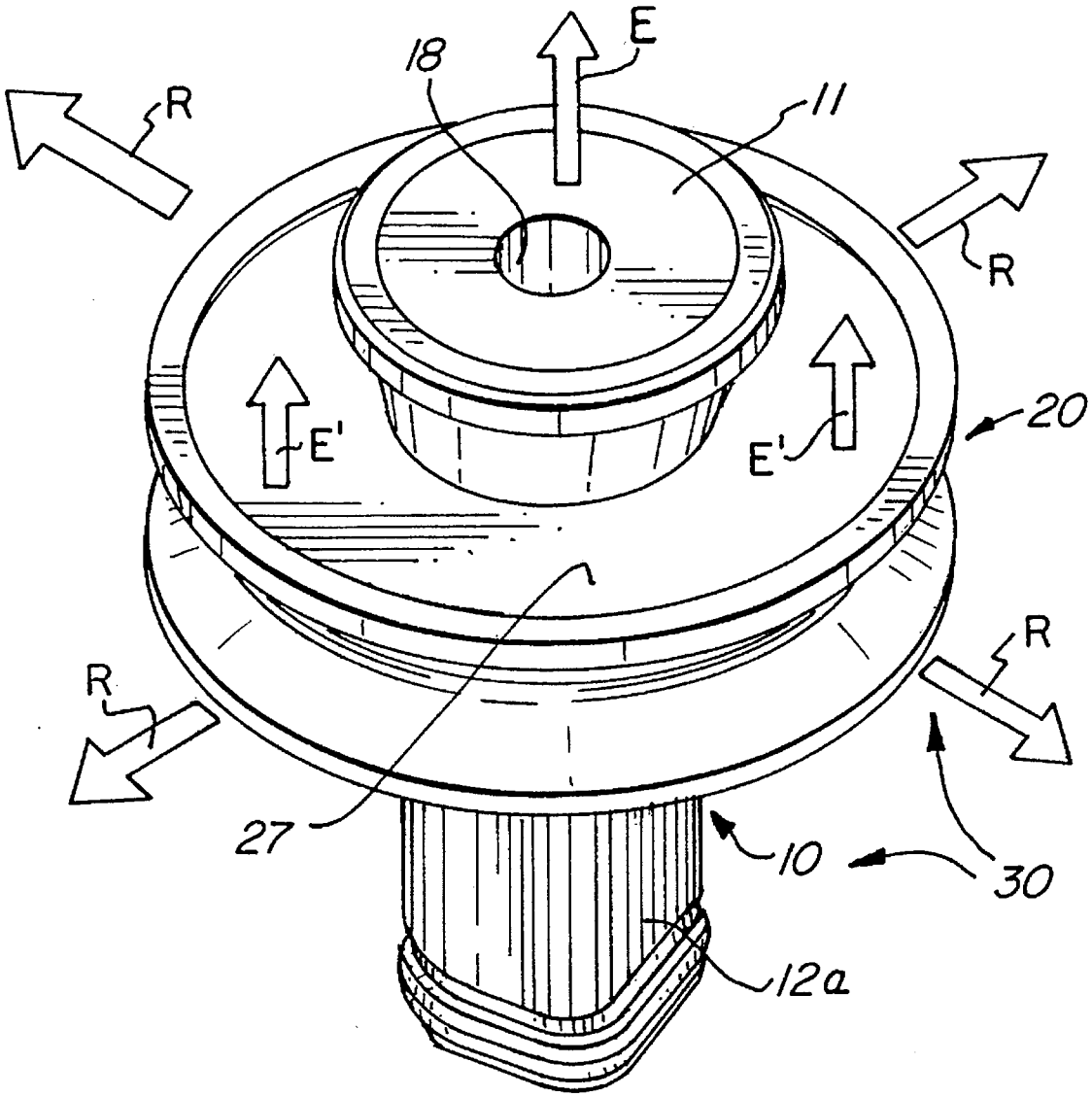
FIG. 5 is a perspective view of the device of FIG. 1 with the accessory charge of FIG. 3 mounted thereon.

As best seen in FIG. 1, device 10 has thereon external mounting means comprising exterior screw threads 32 which are dimensioned and configured to be engaged by interior screw threads 34 (FIG. 3) formed on the inner peripheral surface 28 of accessory charge 20. With this construction, accessory charge 20 is mounted upon device 10 by passing hub opening 29 over coupling end 10*b* of device 10 and rotating accessory charge 20 to engage the interior screw threads 34 thereof with the exterior screw threads 32 of device 10. When fully screwed into place, accessory charge 20 will encircle device 10 and provide a charge assembly 30 (FIG. 5). Obviously, any other suitable means of mounting accessory charge 20 on device 10 may be employed. For example, partial or interrupted threads (not shown) may be substituted for the continuous threads 32, 34 illustrated so that accessory charge 20 may be moved axially relative to booster explosive device 10 and secured therethrough by a partial, e.g., one-quarter or one-third, turn. For another example, detent means and recesses could be provided, respectively, one on the portion of housing 12 within accessory section 10*c* of the device, and the other on the inner peripheral surface 28 of accessory charge 20. Thus, the inner peripheral surface 28 could be provided with projecting fingers dimensioned and configured to engage recesses formed in housing 12 in the vicinity of accessory section 10*c* of device 10. With 10 this configuration, accessory charge 20 may be axially slid over device 10 to engage the projecting fingers. The latter could be integrally molded with the inner peripheral surface 28 of accessory charge 20 and have sufficient resiliency so that they are compressed when accessory charge 20 is axially moved along accessory section 10*c* of device 10, and spring outwardly to engage recesses molded in housing 12 in the vicinity of accessory section 10*c*. In such case, guide means may be provided on the exterior of housing 12 and on inner peripheral surface 28 to align the fingers with the recesses.

When accessory charge 20 is assembled to device 10, upper surface 27 thereof is seen (FIGS. 4 and 5) to extend radially outwardly of the active surface 11 of the primer charge 14 and concave outer peripheral surface 26 faces radially outwardly. Concave outer peripheral surface 26 could optionally be flat or convex in cross-sectional profile. However, in accordance with a preferred embodiment of the invention, as illustrated, outer peripheral surface 26 is of concave cross-sectional shape. This embodiment of outer peripheral surface 26 provides accessory charge 20 as a shaped charge positioned radially outwardly of device 10. The concave outer peripheral surface 26 is preferably symmetrical about a plane passed perpendicularly to the longitudinal axis L'—L' of accessory charge 20.

Figure 10:
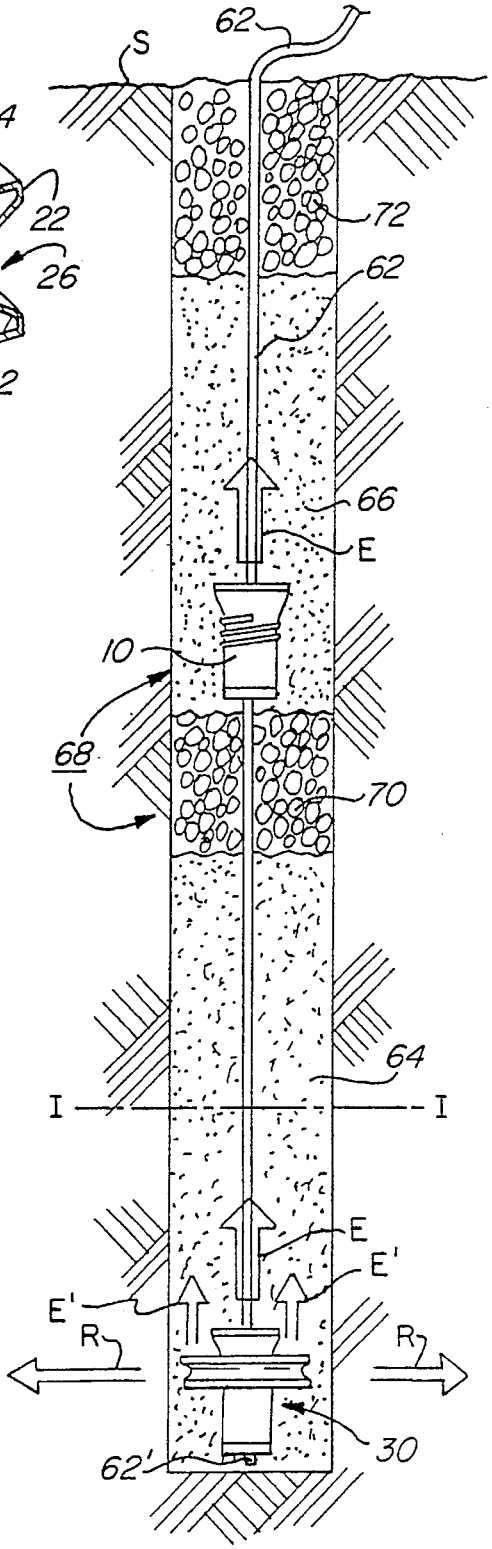
FIG. 10 is a cross-sectional view of a borehole containing the devices of FIGS. 7 and 8.

The resulting shaped charge configuration of the illustrated accessory charge 20 provides enhanced explosive energy output radially outwardly of accessory charge 20 and thereby radially outwardly of the combined charge assembly 30 (FIGS. 4, 5 and 10). The enhanced energy output radially outwardly of charge assembly 30 is indicated by the arrows R in FIG. 5. The effectiveness of the shaped charge provided by the concave shape of the outer peripheral surface 26 of accessory charge 20 will increase radial fracturing of the rock or other formations immediately surrounding the borehole, provided that the diameter of accessory charge 20 is reasonably close to the diameter of the borehole. If the borehole diameter is much greater than the diameter of accessory charge 20, then much of the shaped charge energy will be expended in the surrounding explosive column, the initiation thereof being thereby assisted, but producing less effect with respect to radial fracturing of the surrounding rock or other formation surrounding the borehole. Accordingly, if significant enhancement of radial fracturing of the rock or other formation surrounding the borehole is desired, the diameter of accessory charge 20 should be close to the diameter of the borehole in which it is utilized.

Accessory charge 20 also enhances the energy output emanating from active surface 11 of device 10 by the energy emanating from upper surface 27 of accessory charge 20. The energy emanating from the direction of active surface 11 is indicated by the arrow E in FIG. 5 and that from the upper surface 27 of accessory 20 by the arrows E' in FIG. 5.

Another advantage provided by accessory charge 20 is that it increases the diameter of the booster explosives as compared to that which would be attained by use of the device 10 alone. That is, the diameter of assembly 30 is significantly greater than that of device 10. This is particularly useful in the case of a borehole whose diameter is significantly greater than that of device 10. In such cases, utilization of the charge assembly 30 better matches the effective explosive diameter of the booster explosives to that of the borehole. This is desirable because the pressure pulse generated within the borehole by detonation of the device will, if the diameter of the booster explosives is closely matched to the diameter of the borehole, provide a planar or nearly planar wave throughout the entire diameter of the borehole. On the other hand, if the diameter of the booster explosive, e.g., of explosive booster device 10, is small compared to the diameter of the borehole, the pressure pulse generated will have a spike at the location of the device 10 and be lower and flatter elsewhere in the cross section of the borehole. Utilization of accessory charge 20 thereby provides for a given device 10 the option of converting it to a second, larger diameter charge assembly 30.

Figure 6:
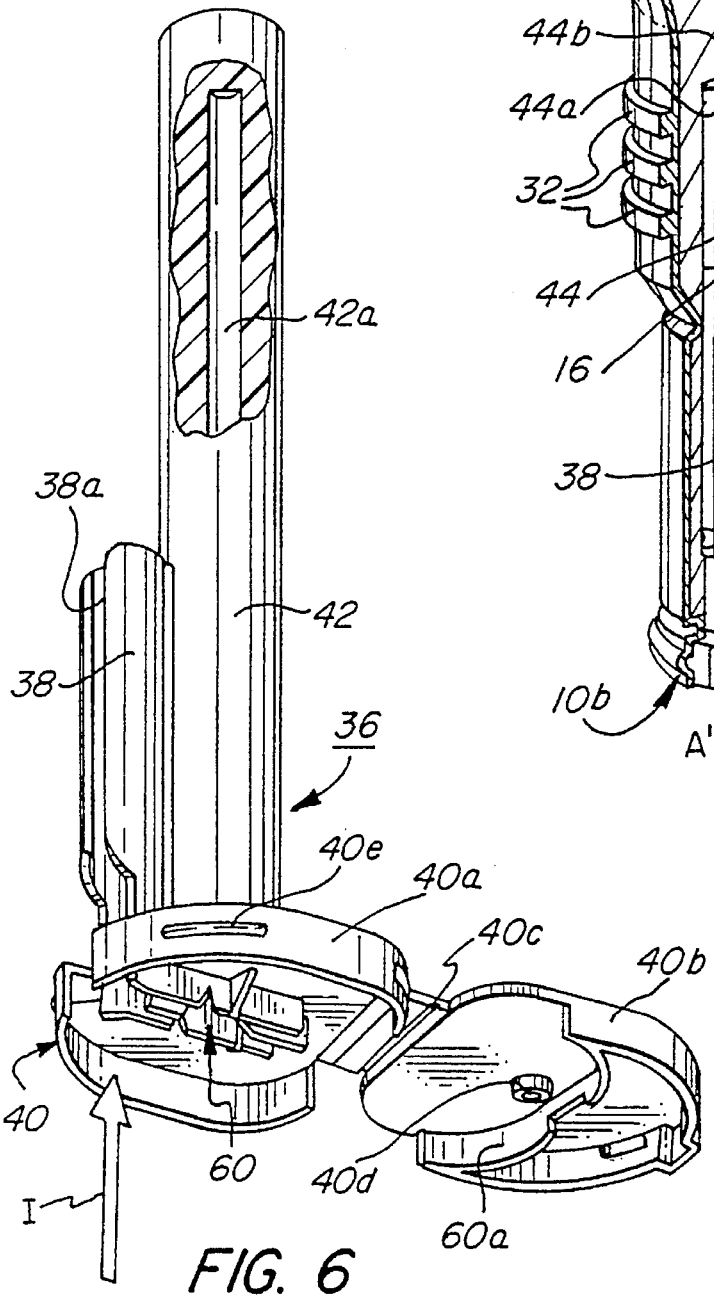
FIG. 6 is a perspective view of a slider unit for use with the device of FIG. 1, showing the base fixture of the slider unit in an open position.

Referring now to FIG. 6 there is shown a slider unit 36 comprising a detonator retainer 38 and a shielding tube 42 carried on a base fixture 40 which, in the illustrated embodiment, is comprised of a base chamber 40*a* and a hinged cover 40*b* which is shown in FIG. 6 in the open position. Shielding tube 42 has a tube bore 42*a* extending entirely therethrough.

Detonator retainer 38 is seen to comprise a tube-like structure having a longitudinally extending slot 38*a* formed therein and otherwise dimensioned and configured to slidably receive therein a detonator 44 (FIG. 7A) having an output end 44*a*. Detonator 44 is inserted, output end 44*a* thereof first, into detonator retainer 38 in the direction indicated by arrow I in FIG. 6. Detonator retainer 38 is dimensioned and configured so that detonators of different size may be positioned therein with, in each case, the output end thereof positioned in close proximity to, or abutting contact with, the end wall 16*a* of detonator well 16.

Within base chamber 40*a* there is formed line retaining means 60 which, as described in detail in co-pending patent application Ser. No. 08/548,813, filed on Jan. 11, 1996 (Attorney Docket P-1451/P-1481), cooperates with complementary line retaining means 60*a* formed in hinged cover 40*b*, to maintain short lead 52 in signal transfer communication with a downline 62, when hinged cover 40*b* is closed about hinge 40*c*. Hinged cover 40*b* has an aperture 40*d* formed therein through which downline 62 is threaded when hinged cover 40*b* is in its closed position. Hinged cover 40*b* is closed by pivoting it about hinge 40*c* and is retained in its closed position by the engagement of a pair of slots and corresponding protruding lips formed in base fixture 40. FIG. 6 shows a protrusion 41 formed at the end of hinged cover 40*b* which is opposite hinge 40*c* and a corresponding recess 43 formed at the end of base chamber 40*a* which is opposite hinge 40*c*. A pair of slots, only one of which, 40*f*, is visible in FIG. 6, are formed one on each opposite side of protrusion 41 and these engage with protruding ridges or lips (not visible in FIG. 6 or elsewhere in the drawings) formed one on each respective side of recess 43. When hinged cover 40*b* is closed by rotating it about hinge 40*c*, protrusion 41 fits within recess 43 and the slots (slot 40*f* and its counterpart) engage the protruding lips formed on either side of recess 43 to lock hinged cover 40*b* in place.

While a detonator having a conventional single line input lead could be emplaced in the slider unit 36 of FIG. 6 for use in conjunction with the explosive booster device of the present invention, it is preferred to employ a detonator having a multiple line input lead, preferably, a looped multiple line input lead, as disclosed in co-pending patent application Ser. No. 08/548,815, filed on Jan. 11, 1996 (attorney Docket P-1462). Aside from the preferred multiple line input lead, the detonator may be of conventional construction and may comprise either a delay detonator (usually) or an instantaneous-acting detonator (rarely).

Figure 7:
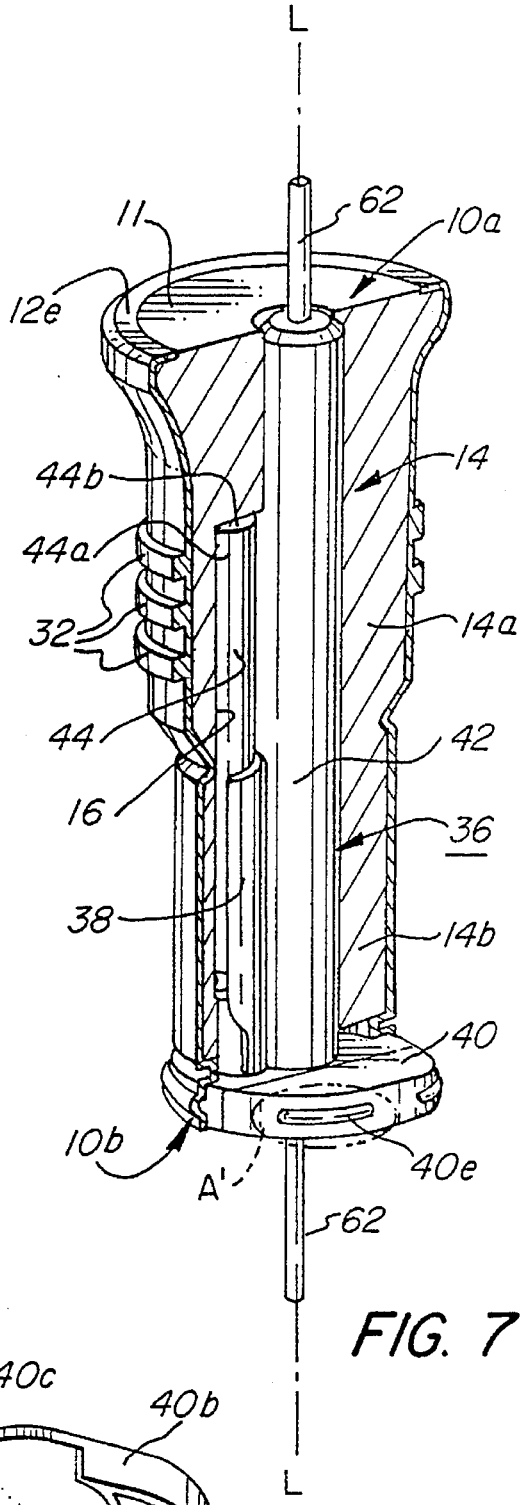
FIG. 7 is a perspective view of a longitudinal cross section of the device of FIG. 1 having the slider unit of FIG. 6 and a delay detonator mounted therein, and a downline extending therethrough.
Figure 7A:
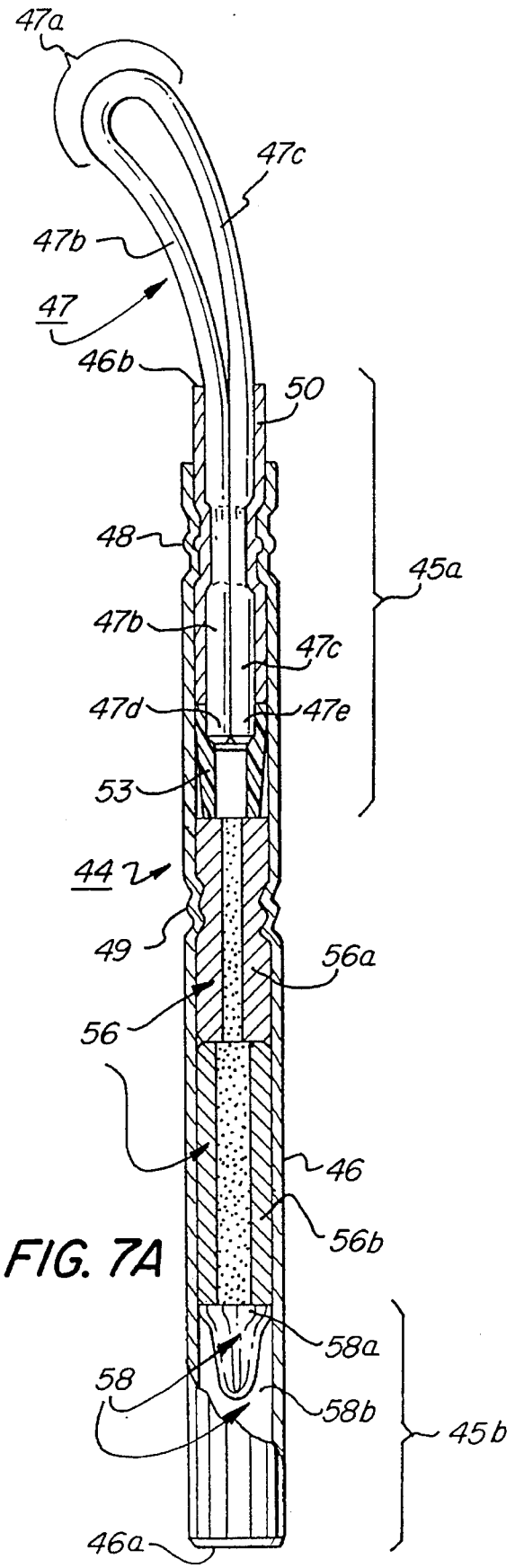
FIG. 7A is a longitudinal cross-sectional view, enlarged relative to FIG. 7, of the detonator 44 shown in FIG. 7.

Referring now to FIG. 7A, a delay detonator is generally indicated at 44 and comprises an elongate tubular casing or shell 46 made of a suitable plastic or metal, such as a semi-conductive plastic material or, as in the illustrated embodiment, a metal such as aluminum or copper. Shell 46 has a closed end 46*a* defining the end of the output section 45*b* and an opposite, open end 46*b* at the entry to the input section 45*a*. The closed end 46*a* is closed by shell 46 which is configured as a continuous wall at closed end 46*a*. The open end 46*b* is open to provide access of components to the interior of shell 46 and is eventually sealed by bushing 50 and bushing crimp 48. Bushing 50 is for this purpose usually made of a resilient material such as a suitable rubber or other elastomeric polymer. In the illustrated embodiment, a looped input lead 47 has a bight portion 47*a* from which extend two signal transmission lines 47*b*, 47*c* each terminating in a respective signal-emitting end 47*d*, 47*e*. Looped input lead 47 is secured within shell 46 with signal-emitting ends 47*d*, 47*e* received within a static electric isolation cup 53 which, as is well-known in the art, serves to divert any static electric charge which builds up in looped input lead 47 to shell 46, thereby preventing accidental detonation of detonator 46 by a static electricity discharge.

A pyrotechnic delay train 56 is disposed within shell 46 and is comprised of a sealer member 56*a* and a delay member 56*b* and a detonator output charge 58 in turn comprised of primary and secondary charges 58*a*, 58*b*, all connected in series and terminating at the closed end 46*a* of shell 46. Pyrotechnic delay train 56 comprises tubes of a readily deformable soft metal, such as lead or modern pewter, which contain a core of a suitable pyrotechnic composition. A second crimp 49 is formed in shell 46 to retain pyrotechnic train 56 in place therewithin. Primary explosive charge 58*a* may comprise any suitable primary explosive, e.g., lead azide or DDNP (diazodinitrophenol), and secondary explosive charge 58*b* may comprise any suitable secondary explosive, e.g., PETN.

As those skilled in the art will appreciate, sealer member 55*a* and delay member 55*b* may be eliminated to provide an instantaneous-acting detonator such as that illustrated in FIG. 7B and described below.

Delay detonators supplied with electronic delay elements in lieu of the pyrotechnic delay train 56 may also be employed. Such electronic delay elements (not shown) may be used in conjunction with any suitable type of input lead, for example, looped input lead 47 made of shock tube or deflagrating tube, which is used to transmit a non-electric, e.g., an impulse signal (which may be amplified or generated by a small amplifier explosive charge, not shown, located within the detonator shell) to generate an electrical signal by imposing the (optionally amplified) impulse signal upon a piezoelectric generator within the shell. The resulting electrical signal is transmitted to an electronic circuit, positioned where delay train 56 of the FIG. 7A embodiment is positioned. The electronic circuit includes a counter to provide a timed delay after which a capacitor circuit is triggered to initiate the output explosive charge. Such electronic delay elements and detonators including the same are disclosed and claimed in U.S. Pat. No. 5,377,592, "Impulse Delay Unit", issued on Jan. 3, 1995 to K. A. Rode et al, and U.S. Pat. No. 5,435,248, "Extended Range Digital Delay Detonator", issued on Jul. 25, 1995 to R. G. Pallanck et al. The disclosures of these patents are hereby incorporated by reference herein. Accordingly, delay detonators may have either a pyrotechnic or an electronic delay element as the immediate target of the signal emitted from the signal-emitting ends 47*d*, 47*e* of signal transmission lines 47*a*, 47*b*.

Figure 7B:
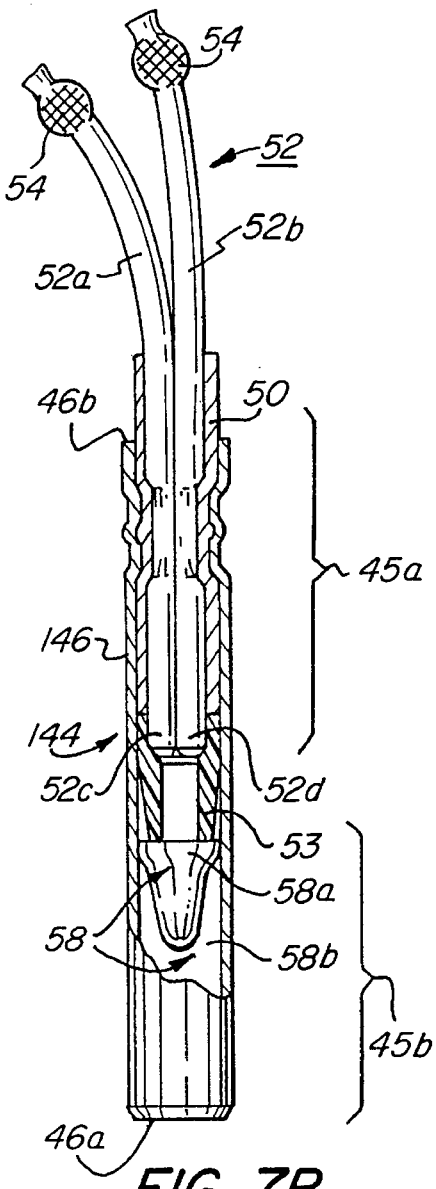
FIG. 7B is a view identical to FIG. 7A but of an instantaneous-acting detonator useable in the slider unit of FIG. 6.

The embodiment of FIG. 7B illustrates an instantaneous-acting detonator 144 which, as is well-known in the art, may be attained by simply omitting the delay train 56 from the construction illustrated in FIG. 7A so that the signal emitted from the signal-emitting ends of the input lead and through isolation cup 53 impinge directly on the detonator explosive charge 58. Shell 146 of detonator 144 consequently is shorter in length than shell 46 of the FIG. 7A embodiment. In the embodiment of FIG. 7B, detonator 144 includes a multi-line input lead 52 comprising suitable signal transmission lines such as a pair of short lengths of shock tube comprising signal transmission lines 52*a*, 52*b* which are closed at their distal ends by seals 54. The signal transmission lines 52*a*, 52*b* pass through bushing 50 and terminate at respective signal transmitting ends 52*c*, 52*d* thereof within shell 146 adjacent to a static electric isolation cup 53. Except as noted above, the other components of instantaneous-acting detonator 144 are identical to those of delay detonator 44 of FIG. 7A, are numbered identically thereto and therefore are not further described with respect to their structure.

A signal induced in looped input lead 47 of FIG. 7A or in multi-line lead 52 of FIG. 7B by any suitable means such as a detonating cord, will pass through isolation cup 53 to initiate either delay train 56 and then output explosive charge 58 (FIG. 7A) or output explosive charge 58 directly (FIG. 7B).

In order to assemble booster explosive device 10, hinged cover 40*b* is opened and a suitable detonator 44 (or 144) is inserted through base chamber 40*a* and into detonator retainer 38, output end 44*a* first, and axially moved through retainer 38 until the detonator 44 is properly positioned therein as illustrated in FIG. 7. Detonator retainer 38 contains on the interior thereof stop means (not shown) dimensioned and configured to engage crimp 48 (or some other feature such as crimp 49) to properly position the detonator 44 or 144 within detonator retainer 38. With detonator 44 or 144 so positioned, upon insertion of slider unit 36 (having detonator 44 or 144 retained therein) within device 10, the output tip 44*b* of detonator 44 is properly positioned immediately adjacent to or in abutting contact with end wall 16*a* (FIG. 2) of detonator well 16. After detonator 44 or 144 is thus properly inserted within detonator retainer 38, looped input lead 47 of detonator 44 (FIG. 7A) or multi-line input lead 52 of detonator 144 (FIG. 7B) is engaged with line-retaining means 60 and hinged cover 40*b* is closed to retain the engaged input lead 47 or 52 in place. Slider unit 36 is then inserted within device 10 by aligning shielding tube 42 with line well 18 and detonator 44 in detonator retainer 38 with detonator well 16. The assembly of the detonator within slider unit 36 is normally carried out by factory assembly, so that in the field the user need not be concerned about properly seating the detonator and its input lead within slider unit 36, but need merely insert the pre-assembled slider unit/detonator assembly into the booster device 10.

Figure 2A:
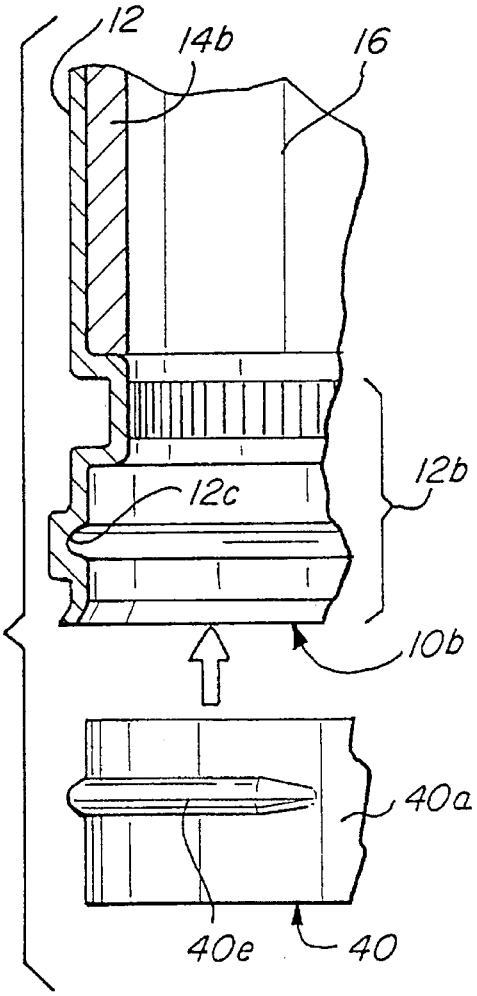
FIG. 2A is an exploded, partial elevation view enlarged relative to FIGS. 2 and 7, of approximately that portion of FIG. 2 which is enclosed by the dash-line area A and that portion of FIG. 7 which is enclosed by dash-line area A'.

As shown in FIG. 2A, base fixture 40 has base engagement means comprising, in the illustrated embodiment, projections 40*e* formed about the periphery thereof. Coupling end 10*b* of device 10 is comprised of an extension end 12*b* which has housing engagement means comprising, in the illustrated embodiment, recesses 12*c* formed thereon. Projections 40*e* of base fixture 40 are dimensioned and configured to be snap-inserted into, and engage with recesses 12*c* of, housing 12, so that slider unit 36 will positively engage and lock to housing 12 with shielding tube 42 received within line well 18 and detonator 44 and its detonator retainer 38 received within detonator well 16.

In order to connect the assembled device as part of a blasting system, a downline 62, which may comprise any suitable brisant signal transmission line, such as a detonating cord, for example, a low energy detonating cord containing therein from about 1.2 to 1.7 grams per meter (6 to 8 grains per foot) of a suitable high explosive such as PETN, HMX, RDX or plastic bonded explosive ("PBX") is threaded through tube bore 42*a* (FIG. 6) of shielding tube 42 from active surface 11 of device 10 (FIGS. 7 and 8) and passed through base fixture 40 via aperture 40*d* in signal transfer engagement with input lead 52. Input lead 47 or 52 is retained in such engagement by its engagement thereof with line-retaining means 60 and complementary line-retaining means 60*a*. The insertion of slider unit 36 with detonator 44 thereon as described above prepares device 10 by placing it in condition to be initiated by downline 62 via input lead 47 or 52.

As is well-known to those skilled in the art, device 10 may slide along downline 62 to a selected depth within a borehole or other formation within which device 10 is to be utilized, as described in more detail below. It will further be appreciated by those skilled in the art that conventional single input lead line detonators may also be employed in accordance with the present invention. However, multi-line input leads, and particularly the looped input lead illustrated in FIG. 7A hereof, are preferred because they provide redundant signal inputs to the detonator thereby drastically reducing if not eliminating altogether initiation failures. The multi-line input leads provide multiple contact points and better contact between downline 62 and the input leads 47 or 52 while nonetheless permitting good sliding contact between downline 62 and the input leads. The multi-line input lead construction is described in co-pending patent application Ser. No. 08/548,815, filed on Jan. 11, 1996 (attorney Docket P-1462).

In order to provide a charge assembly such as charge assembly 30 illustrated in FIGS. 4, 5 and 8, one simply adds to the assembly of slider unit 36 and detonator 44 within device 10 attained as described above, accessory charge 20. This is attained by mounting accessory charge 20 on device 10 as described above by engaging interior screw threads 34 of accessory charge 20 with the exterior screw threads 32 of device 10. Charge assembly 30 may then be threaded upon a suitable downline 62 in the same manner as device 10.

It will be noted that whether or not accessory charge 20 is mounted upon device 10, downline 62 extends through the geometric center of device 10 and of charge assembly 30, i.e., downline 62 is coincident with the longitudinal axis of both device 10 and charge assembly 30. This facilitates smooth sliding of either device 10 or charge assembly 30 along downline 62 until the desired location is reached.

The provision of accessory charge 20 supplements the total energy output attainable to initiate a main blasting charge by combining energy output E (FIG. 5) of primer charge 14 with energy output E' of accessory charge 20. Further, by providing accessory charge 20 with the configuration of a shaped charge as illustrated in the Figures, enhanced radial output energy as indicated by the arrows R in FIG. 5 is also attained. Both features provide significant advantages. As is known in the art, main blasting charges, that is, blasting agents, such as (FIG. 10) first blasting charge 64 and second blasting charge 66 contained within a borehole 68 are initiated by booster charges located at or very close to the bottoms of the respective high blasting charges. Accordingly, it is desired to direct the maximum amount of energy from initiation of the booster charge upwardly into the main mass of the blasting charge within which the booster charge is located.

In order to prepare the borehole 68, a suitable downline 62, such as a low energy detonating cord, is threaded through a booster charge assembly 30 (having a detonator suitably mounted therein) and is knotted (as indicated at 62' in FIG. 10) to retain charge assembly 30 thereon. Charge assembly 30 is then lowered to the bottom of borehole 68 by means of downline 62 while maintaining one end of downline 62 at the surface S. First blasting charge 64 is then poured into borehole 68 followed by a stemming material such as gravel to provide intermediate stemming section 70. The blasting charges 64 and 66 may be any suitable explosive or blasting agent such as an ammonium nitrate-fuel oil ("ANFO") composition. At that point a device 10 having a detonator suitably mounted therein is threaded onto downline 62, which comprises detonating cord, and is lowered into borehole 68 by sliding by gravity along downline 62 until it encounters the top of intermediate stemming section 70. Second blasting charge 66 is then poured into borehole 68 and material to provide top stemming charge 72 is added thereover. The portion of downline 62 left on the surface is connected into a suitable blast initiation set-up which usually includes interconnection to explosive in numerous other boreholes. As is well-known to those skilled in the art, a borehole may contain only one booster charge or may contain two or more booster charges arranged at different levels in the borehole.

The arrangement shown in FIG. 10 provides a charge assembly 30 at the bottom of borehole 68 and will enhance the energy output radially as indicated by the arrows R. As is well-known to those skilled in the art, boreholes such as boreholes 68 are usually arranged in rank and file array and the enhanced radial output R will help to provide a more even bottom surface of the trench formed by detonating a plurality of boreholes 68. Further, accessory charge 20 of charge assembly 30 will also supplement the energy E directed upwardly into the column of first blasting charge 64 with the additional energy E' emanating from accessory charge 20.

In use, downline 62 is initiated at the Surface S by any suitable means (not shown) and the resulting signal travels through downline 62 to initiate a signal in the input lead 52 of each of the armed devices 10 and charge assemblies 30. The speed of travel of the signal through the detonating cord downline 62 is so high that each input lead 52 of the devices 10 and charge assemblies 30 may be considered to be initiated substantially simultaneously. The signal initiated in the input lead 47 initiates the respective delay trains 56 in the detonators 44 and after the resulting delay period, e.g., from 50 to 1000 milliseconds or more, the respective detonator explosive charges 58 are initiated, which initiates their associated devices 10 and/or charge assemblies 30, which in turn initiate their associated main blasting charges 64, 66. As those skilled in the art will appreciate, the delay periods of the respective detonators 44 will be selected so that in a given borehole the charge assemblies 30 and/or devices 10 will be initiated in sequence delay starting from the bottom of a borehole to the top thereof. In some few cases, it may be desired to utilize for one or more of the booster charges in a borehole an instantaneous-acting detonator such as detonator 144 of FIG. 7B. However, normally delay detonators are utilized in boreholes for reasons well-known to those skilled in the art.

Shielding tube 42 is thick enough to protect primer charges 14 from being initiated or cracked by the explosive force of the detonating cord comprising downline 62. If downline 62 were to directly initiate the primer charge 14 the timing sequence provided by delay trains 56 would be superseded with resulting dire consequences for the effectiveness of the blast pattern. If downline 62 shatters or cracks primer charge 14, the reliability of initiation by detonators 44 is compromised.

Figure 9:
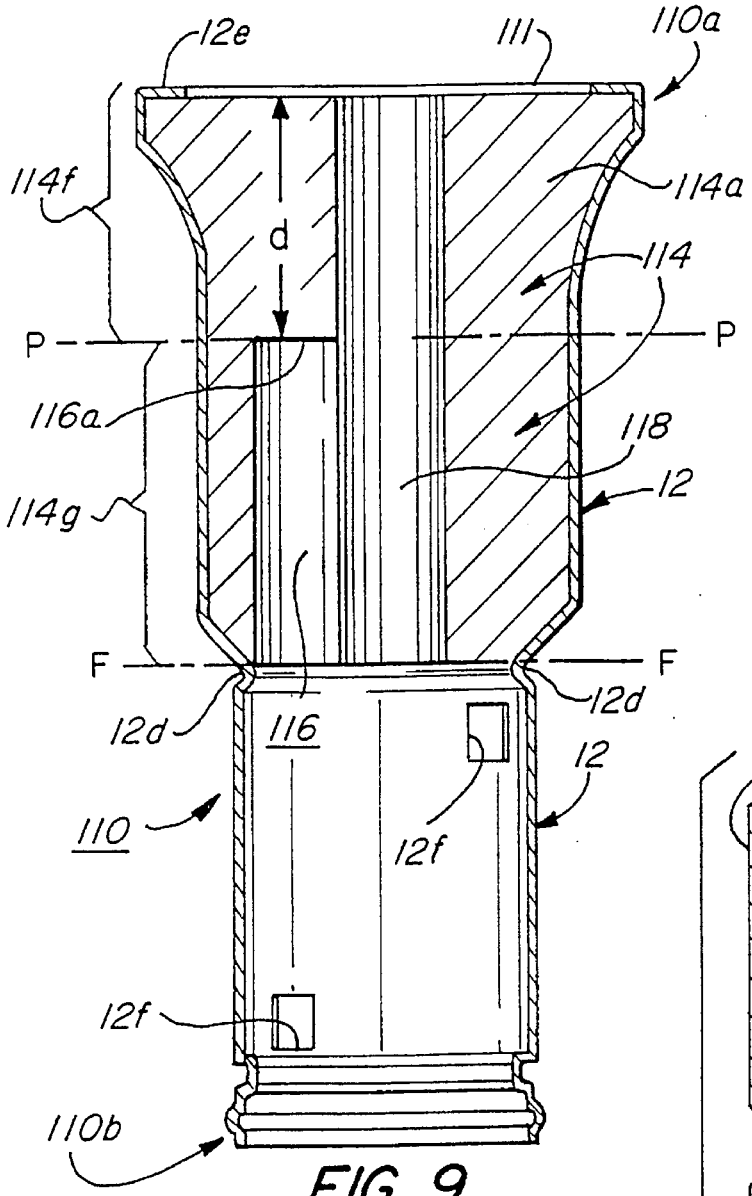
FIG. 9 is a view corresponding to FIG. 2, but enlarged relative thereto, of another embodiment of the booster explosive device of the present invention.

Referring now to FIG. 9, there is shown an alternate embodiment of the present invention comprising a booster explosive device 110 having formed therein a detonator well 116 and a line well 118. (Except for the omission of the equivalent of stem portion 14*b* of the FIG. 2 embodiment, the FIG. 9 embodiment is substantially the same as that of the FIG. 2 embodiment. Accordingly, corresponding components are not further described and are identically numbered as in FIG. 2 except for the addition of a prefix 1.) In this embodiment, as in the embodiment of FIG. 1, the end wall 116*a* of detonator well 116 defines a point beyond which output end of detonator 44, i.e., the closed end 46*a* of shell 46, does not extend. One feature of the present invention provides that the output end of detonator 44 is positioned in close poximity to or in abutting contact with end walls 16*a* (FIG. 2) and 116*a* (FIG. 9), respectively. A plane P—P passed perpendicularly to longitudinal axis L—L at end wall 116*a* of detonator well 116 divides primer charge 14 into two portions, a portion 114*f* located between plane P—P and active end 110*a* of device 110, and a second portion 114*g* located between plane P—P and coupling end 110*b* of device 110. One aspect of the present invention provides that the amount of primer charge 14 or 114 disposed on the side of plane P—P opposite the side thereof on which detonator 44 is located, comprises at least about 50 percent by weight of the total weight of primer charge 14, preferably from about 50 to 75 percent by weight of the primer charge 14. This applies both to the embodiment of FIG. 2 and to that of FIG. 9, as it is a general aspect of the invention. By thus insuring that at least about 50 percent, preferably from about 50 to 75 percent by weight of the total weight of primer charge 14 or 114 is disposed between the output end of detonator 44 and the active end 10*a* or 110*a* of device 10 or 110, enhanced output of energy as indicated by the arrows E in FIGS. 5 and 10 is attained. The 25 to 50 percent by weight of the total weight of primary charge 14 or 114 disposed in the side of plane P—P on which the detonator 44 is located, i.e., below plane P—P as viewed in FIG. 9, provides a reserve which also helps to initiate any blasting agent which may be positioned below device 110.

It is another feature of the invention that housing 12 is configured so that primer charge 114 of the FIG. 9 embodiment may be made smaller than primer charge 14 of the FIG. 1 embodiment and may comprise only a main portion 114*a* without a stem equivalent to stem portion 14*b* of the FIG. 2 embodiment. Thus, in casting the explosive to form the primer charge 114 of the FIG. 9 embodiment, housing 12 is filled only to the plane F—F which is taken perpendicularly to longitudinal axis L—L at the constriction 12*d* formed in housing 12. Once the molten charge hardens to provide main portion 114*a*, the constriction 12*d* in cooperation with rim 12*e* formed at larger diameter end 12*a* of housing 12 will retain the solidified main portion 114*a* securely in place. In this embodiment of the invention, in which the stem portion equivalent to 14*b* of the FIG. 2 embodiment is omitted, the resulting void space surrounding shielding tube 42 after slider unit 36 is inserted within the device 110 may present a problem in lowering the device 110 into boreholes which contain a fluid such as a liquid, e.g., water, or a slurry explosive. For this reason, one or more apertures such as apertures 12*f* (FIG. 9) are formed in the lower portion of housing 12, that is, in the portion of the housing 12 which in the FIG. 2 embodiment encloses stem portion 14*b* of primer charge 14. Apertures 12*f* admit such fluid into housing 12 in order to reduce the bouyancy of device 110 and allow it to sink to the bottom of the fluid-containing borehole or of the deck of the fluid-containing borehole in which it is located. Preferably, two or more such apertures 12*f* are provided in order to facilitate the ingress of the fluid into the lower portion of housing 12 and the escape of air therefrom in order to sink the device 110 within the liquid in which it is placed.

A typical explosive weight (i.e., the weight of primer charge 14) for explosive booster devices such as device 10 of FIG. 2 or device 110 of FIG. 9 is about 8 to 12 ounces of explosive and a typical size is a height of from about 12.7 to 15.2 centimeters ("cm"), i.e., 5 to 6 inches, a diameter of from about 5.4 to 5.6 cm (2.1 to 2.2 inches) as measured along plane P—P of FIG. 9 and a diameter of about 7.0 to 7.2 cm (2.76 to 2.83 inches) at the active surface 11 or 111. In the illustrated embodiment of FIG. 9, the distance d between the end wall 116*a* of detonator well 116 and the active surface 111 of primer charge 14 is preferably about 3.18 cm (1.25 inches). The same applies to the embodiment of FIG. 2 wherein for a device 10 whose primer charge 14 is 12 ounces in weight, the quantity of explosive on the side of plane P—P opposite the side on which detonator 44 is positioned, i.e., above the end wall 16*a*, is about 4.7 ounces. This contrasts to conventional cylindrical booster devices of uniform circular cross section wherein the end wall of the detonator well is about 1.91 cm (¾ inch) below the active surface (equivalent to 11 in FIG. 2) of the booster so that only about 2.8 ounces of explosive of a sixteen ounce prior art booster is above the detonator well end wall. By having the active end of primer charge 14 (FIG. 2) or 114 (FIG. 9) flare outwardly to increase the diameter of active surface 11 or 111 thereof, and placing the output tip 44*b* of detonator 44 a greater distance away from active surface 11 or 111, the total energy output E (FIGS. 5 and 10) for initiating explosives positioned above the explosive booster device 10 or 110 is increased relative to prior art designs. Essentially, the relatively greater quantity of primary explosive 14 or 114 located above the point of initiation at output tip 44*b* of detonator 44 and the increased area of surface 11 or 111 enhances the energy transfer E to the borehole explosive positioned above the explosive booster device 10 or 110.

In situations where the device 10 (FIG. 2) or 110 (FIG. 9) is positioned at the bottom of a borehole or immediately above a non-explosive stemming layer of the borehole, (e.g., stemming section 70 in FIG. 10) the downward output of energy from the booster is unimportant because there is no explosive for it to detonate. In such cases, savings are effectuated by utilizing a device such as explosive booster device 110 of FIG. 9. By eliminating the quantity of explosive below constriction 12*d* (at plane F—F in FIG. 9), a savings in the quantity of explosive required is effectuated. If the device 110 is positioned at the bottom of a borehole or immediately atop a stemming section, no significant loss of operating efficiency is incurred. On the other hand, if the explosive booster device is to be positioned at an intermediate location within a column of explosive, e.g., at line I—I in FIG. 10, then an embodiment such as the device 10 of FIG. 2, wherein both a main portion 14*a* and stem portion 14*b* of primer charge 14 is provided, is desirable and effective. This is because the downward output of energy from stem portion 14*b* will be effective in initiating that portion of the main blasting charge (64 in FIG. 10) positioned beneath the device 10, which provides good booster energy in the downhole as well as in the uphole directions.

While the invention has been described in detail with respect to specific preferred embodiments thereof, it will be recognized by those skilled in the art that numerous variations may be made thereto which variations nonetheless comprise substantial equivalents of the preferred embodiments and otherwise lie within the spirit and scope of the appended claims.

What is claimed is:

1. An explosive accessory charge for mounting on a booster explosive device having (a) a longitudinal axis, (b) a housing having a housing exterior and within which housing an explosive primer charge is enclosed, the accessory charge being dimensioned and configured to be mounted on the booster device radially outwardly thereof.

2. The accessory charge of claim 1 comprising accessory mounting means dimensioned and configured to engage the accessory charge with the booster device.

3. The accessory charge of claim 1 dimensioned and configured to circumscribe such booster device.

4. The accessory charge of claim 1 having a toroidal configuration including a hub opening dimensioned and configured to enclose such booster device therein.

5. The accessory charge of claim 1 wherein such booster device has device mounting means on the exterior thereof, and the accessory charge has accessory mounting means thereon, and wherein the device mounting means and the accessory mounting means are dimensioned and configured to engage each other to mount the accessory charge on such booster device.

6. The accessory charge of claim 5 having a toroidal configuration including a hub opening dimensioned and configured to enclose such booster device therein.

7. The accessory charge of claim 6 wherein the accessory mounting means are located on the hub opening of the accessory charge.

8. The accessory charge of claim 7 wherein the hub opening is defined by a hub wall and the accessory mounting means comprise accessory screw threads formed on the hub wall.

9. The accessory charge of claim 8 in combination with such explosive booster device.

10. The accessory charge of claim 9 wherein the device mounting means comprises device threads formed on the exterior of the housing of the explosive booster device, which device threads are complementary to the accessory screw threads.

11. The accessory charge of claim 9 wherein the booster device has an active end and an opposite coupling end and the device and accessory mounting means are dimensioned and configured to locate the accessory charge between the active end and the coupling end.

12. The accessory charge of claim 9 wherein the booster device contains a primary charge comprised of a main body disposed adjacent the active end of the device and a stem portion disposed adjacent the coupling end of the device, and the device and accessory mounting means are each dimensioned and configured to position the accessory charge radially outwardly of the main body when the accessory charge is coupled to the booster device.

13. The accessory charge of claim 9 or claim 10 wherein the accessory charge is of toroidal configuration and circumscribes the entire periphery of the explosive device when the accessory charge is connected thereto.

14. The accessory charge of claim 9 or claim 10 having an outer peripheral surface which is concave in cross section whereby the accessory charge comprises a shaped charge facing radially outwardly thereof.

15. The accessory charge of any one of claims 1 through 6 having an outer peripheral surface which is concave in cross section whereby the accessory charge comprises a shaped charge facing radially outwardly thereof.

16. The accessory charge of claim 1, claim 2 or claim 3 wherein the accessory charge is of toroidal configuration and has a generally circular outer peripheral surface and a hub opening defined by an inner peripheral surface.

17. The accessory charge of claim 16 further having respective top and bottom surfaces which are substantially flat.

18. The accessory charge of claim 16 wherein the outer peripheral surface is concave in cross section so that the accessory charge comprises a shaped charge directed radially outwardly thereof.

19. The accessory charge of claim 18 where the concave surface is symmetrical about a plane passed perpendicularly to the longitudinal axis of the accessory charge.

* * * * *

UNITED STATES PATENT AND TRADEMARK OFFICE

CERTIFICATE OF CORRECTION

PATENT : 5,614,693

DATED : March 25, 1997

INVENTOR(S) : Brendan M. Welch

It is certified that error appears in the above-identified patent and that said Letters Patent is hereby corrected as shown below:

In column 2, line 28, replace "primary" with –primer--.

In column 3, line 31, replace "primer" with --Primer--.

In column 5, line 6, after "With" delete "10".

In column 10, line 39, replace "Surface" with --surface--.

In column 11, line 35, insert a comma after "percent";
line 40, replace "primary" with --primer--.

In column 12, line 38, replace "primary explosive" with --primer charge--;

In claim 12, column 14, lines 8-9, replace "of claim 9 wherein the boster device contains a primary charge" with --of claim 11 wherein the primer charge contained the booster device is--.

UNITED STATES PATENT AND TRADEMARK OFFICE

CERTIFICATE OF CORRECTION

PATENT : 5,614,693

DATED : March 25, 1997

INVENTOR(S) : Brendan M. Welch

It is certified that error appears in the above-identified patent and that said Letters Patent is hereby corrected as shown below:

In claim 19, column 14, line 38, replace "where" with –wherein--.

Signed and Sealed this

Twenty-sixth Day of May, 1998

*Attest:*

Bruce Lehman

BRUCE LEHMAN

*Attesting Officer*

*Commissioner of Patents and Trademarks*